US005488918A

United States Patent [19]

Johnson, Jr. et al.

[11] Patent Number: 5,488,918

[45] Date of Patent: Feb. 6, 1996

[54] OPTIMIZED BARGE BOW FORM AND METHODS OF USE THEREOF

[75] Inventors: Fontain M. Johnson, Jr., Cincinnati, Ohio; Jerry M. Williams, Villa Hills, Ky.

[73] Assignee: Fontain M. Johnson, Santa Claus, Ind.

[21] Appl. No.: 694,890

[22] Filed: May 2, 1991

[51] Int. Cl.[6] ..... B63B 1/00

[52] U.S. Cl. ..... 114/56; 114/26; 114/60; 114/72

[58] Field of Search ..... 114/26–38, 56, 114/63, 72–76

[56] References Cited

U.S. PATENT DOCUMENTS

| | | | |
|---|---|---|---|
| 125,700 | 4/1872 | Snyder | 114/26 |
| 129,982 | 7/1872 | Paterson | 114/26 |
| 152,877 | 7/1874 | Snowdon | 114/26 |
| 221,412 | 11/1879 | Jones | 114/26 |
| 652,876 | 7/1900 | Andrade | 114/62 |
| 819,633 | 5/1906 | Bowman | 114/26 |
| 852,987 | 5/1907 | Theiss | 114/26 |
| 915,410 | 3/1909 | Bowman | 114/26 |
| 929,139 | 7/1909 | Kirchner | 114/26 |
| 988,289 | 3/1911 | Callen | 114/73 |
| 1,253,645 | 1/1918 | Taylor | 114/26 |
| 1,400,298 | 12/1921 | Lambert | 114/73 |
| 2,299,992 | 10/1942 | Kennedy | 114/79 |
| 2,330,022 | 9/1943 | Baier | 114/79 |
| 2,454,998 | 11/1948 | Dosker | 114/26 |
| 2,546,353 | 3/1951 | Williamson | 114/26 |
| 2,699,135 | 1/1955 | Steiner | 114/63 |
| 2,791,980 | 5/1957 | Best, Jr. | 114/56 |
| 3,158,125 | 11/1964 | Malmberg | 114/56 |
| 3,267,896 | 8/1966 | Costa | 114/56 |
| 4,003,327 | 1/1977 | Finsterwalder | 114/65 A |
| 4,011,826 | 3/1977 | Yee | 114/65 A |
| 4,753,184 | 6/1988 | Schiavone | 114/56 |
| 4,928,613 | 5/1990 | Rudolf | 114/63 |
| 4,948,898 | 3/1991 | Dufrene | 114/56 |

*Primary Examiner*—Robert J. Oberleitner
*Assistant Examiner*—Clifford T. Bartz
*Attorney, Agent, or Firm*—Wood, Herron & Evans

[57] ABSTRACT

A barge for the commercial shipping of cargo along an inland waterway having an economically optimized bow, a stern, elongated sidewalls extending between the bow and the stern, and a bottom interconnecting the bow, stern and sidewalls. The bow has a profile within a longitudinal centerline plane of symmetry defined by a fullness which is defined by a block coefficient. The bow also has a corresponding radius within the longitudinal centerline plane. The fullness and the radius of the bow are optimized for economic performance of the barge, which is dependent upon revenue generated by shipping cargo in the barge along a waterway, fuel costs associated with overcoming resistance to propel the barge along a waterway, and maintenance and repair costs associated with propelling the barge along a waterway. The barge has a block coefficient in the range of about 0.96 to about 0.988, with a corresponding radius ranging from about 10' to about 22'. In a preferred embodiment, the barge has a block coefficient of about 0.976 and a corresponding radius of about 14'.

25 Claims, 6 Drawing Sheets

MODEL CONFIGURATIONS IN 15 BARGE FLOTILLA

OPTIMIZED BARGE BOW FORM AND METHODS OF USE THEREOF

FIELD OF THE INVENTION

This invention relates to marine vessels, and more particularly to a barge having an economically optimized bow form.

BACKGROUND OF THE INVENTION

Raked barges are well known in the art. The industry standard for the past several decades has been a 195 ft. by 35 ft. raked barge, known as a "semi-integrated jumbo" barge, having a bow form characterized by a radius usually greater than 30 ft., with the standard radius for a "jumbo" barge being about 40 ft. This radius defines the barge bow profile within a longitudinal centerline plane of symmetry of the barge. Such a barge bow form has a fullness associated therewith which can be defined in terms of a block coefficient equalling about 0.936, where the block coefficient is defined as:

$$C_B = V/LBT,$$

where $C_B$ is the block coefficient,

V is the volume of displacement,

L is the length on waterline,

B is the beam, and

T is the draft.

There has been little attention to, or analysis of, the design of inland dry cargo barges over the past 40 years. The attention to and analysis of barges during this time frame usually related to accommodating construction methods, including production line construction methods. While in the late 1940's and early 1950's a significant amount of barge model hydrodynamic testing was performed, this perhaps represents the last time that serious consideration was given to the hydrodynamics, and hence bow form, of inland dry cargo barges. Since then, the industry has apparently been of the view that barges are simple boxes about which it knows everything that needs to be known.

Literature documenting and industry sources concerned with the development of inland cargo barge design indicate that the primary interest has been lowest barge construction cost. The economic analysis associated with the hydrodynamic design has consisted, for the most part, of an evaluation of a single barge or a small flotilla at the design speed where the lowest resistance per ton displacement was the best. In short, there seemingly is little, if any, evidence to suggest that the existing standard barge bow forms were ever determined to be economically optimum.

In view of the significant role that barges play in commerce on the inland waterways, it would be highly desirable to improve efficiency in their utilization. Specifically, it would be desirable to determine an economically optimum barge bow form wherein the maximum profit is obtained, thereby maximizing barge economic efficiency.

SUMMARY OF THE INVENTION

In accordance therewith, the present invention is directed to a barge bow form which is optimized for economic performance of the barge. The barge is for commercial shipping of cargo along an inland waterway and has a bow, a stern, elongated sidewalls extending between the bow and the stern, and a bottom interconnecting the bow, stern and sidewalls. The bow has a profile within a longitudinal centerline plane of symmetry defined by a fullness with a corresponding radius. The fullness is defined by a block coefficient. The fullness and the bow radius are optimized for economic performance of the barge, which performance is dependent upon revenue generated by shipping cargo in the barge along a waterway, fuel costs associated with overcoming resistance to propel the barge along a waterway, and maintenance and repair costs associated with propelling the barge along a waterway.

A barge of the present invention has a block coefficient ranging from about 0.96 to about 0.988, and a corresponding radius ranging from about 10' to about 22'. In the preferred embodiment of the present invention, the barge has a block coefficient of about 0.976 and a corresponding bow radius of about 14'.

According to the present invention, the fullness and radius of the barge are optimized for economic performance of the barge along a waterway by evaluating its capacity, speed, horsepower required to overcome resistance, running time, fuel costs, and maintenance and repair costs. Barge speed normally ranges up to about 15 mph, and capacity upon which economic performance may be optimized is either fullness, deadweight or tonnage.

Essentially, the fullness and bow radius of the barge are optimized to provide a barge capacity and resistance to movement along a waterway such that revenue generated by shipping cargo in the barge, less the sum of fuel costs associated with overcoming resistance to propel the barge along a waterway and maintenance and repair costs, is maximized.

The invention also provides a method of shipping cargo in a barge along an inland waterway by determining an optimum profile of a barge bow defined by a fullness with a corresponding radius and block coefficient, providing a barge having the same radius and block coefficient, loading cargo into the barge, and propelling the barge along a waterway with fuel consuming propulsion means.

More particularly, according to the methodology of the present invention the optimum block coefficient and radius are determined by determining a difference in revenue based upon a difference in deadweight shipped at a modified speed with a modified bow and deadweight shipped at a present speed with an existing bow. A difference in fuel costs is determined based upon differences in horsepower and run time required to traverse the waterway in a barge with a modified bow and in a barge with an existing bow. A difference in propulsion related maintenance and repair costs is determined based upon a difference in run time required to traverse a waterway in a barge with a modified bow and in a barge with an existing bow. In the final analysis, the changes in revenue, fuel costs, and maintenance and repair costs are compared to determine the optimum block coefficient and bow radius.

In addition, the present invention contemplates a plurality of barges configured into a flotilla. The flotilla can include any number of barges. The flotilla may include all raked barges or a combination of raked barges and box barges (both ends square). The raked barges are usually located in the forwardmost rows with the raked end forward, and in the aftmost rows with the raked end aft. The flotilla is generally N barges wide by M barges long and includes either all raked barges or a combination of raked and box barges. The raked barges in the flotilla have a bow form fullness defined by a block coefficient and a corresponding radius. The fullness and the radius of the raked barges are optimized for economic performance of each raked barge, and hence the flotilla. The barges in the flotilla have block coefficients ranging from about 0.96 to about 0.988 and have corresponding radii ranging from about 10' to about 22'. In the preferred embodiment of the flotilla, the raked barges have a block coefficient of about 0.976 and a corresponding radius of about 14'.

The fullness and radius of the barges in the flotilla are optimized for economic performance by evaluating its capacity based upon deadweight or tonnage, speed, up to about 15 mph, horsepower required to overcome resistance, running time, fuel costs, and maintenance and repair costs. The fullness and bow radius of the barges in the flotilla are optimized to provide a barge capacity and resistance to movement such that revenue generated by shipping cargo, less the sum of fuel costs associated with overcoming resistance and maintenance and repair costs, is maximized.

These and other objects and advantages of the present invention will become more readily apparent by the following detailed description taken in conjunction with the drawings herein, in which:

DESCRIPTION OF THE PREFERRED EMBODIMENT

A. The Barges

Figure 1:
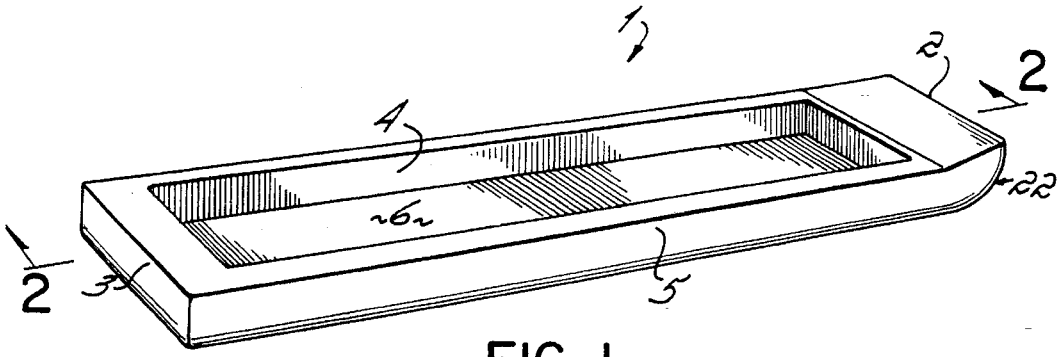
FIG. 1 is a perspective view of the barge of the present invention having a 14' radius bow.
Figure 2:
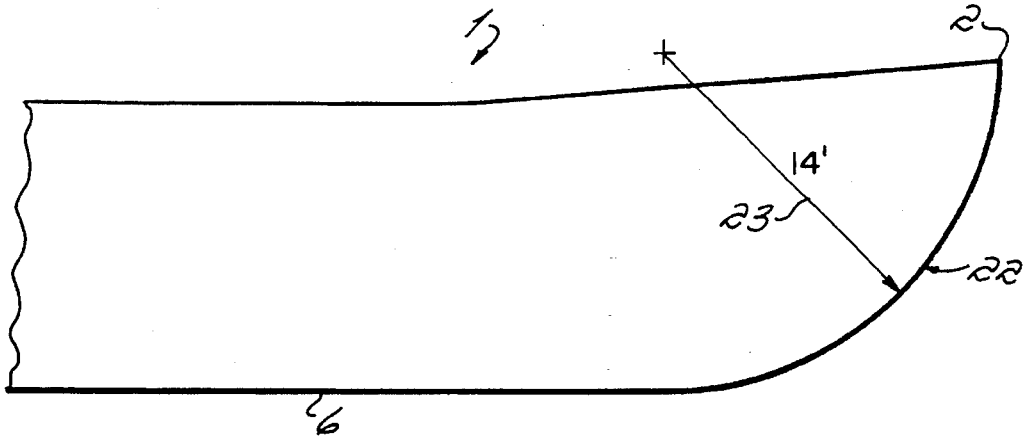
FIG. 2 is a longitudinal centerline profile view of the bow of the barge of FIG. 1 taken along lines 2—2.

Referring first to FIGS. 1 and 2, there is illustrated a barge 1 of the present invention. The barge 1 comprises a bow 2, a stern 3, a pair of elongated side walls 4 and 5 extending between the bow 2 and the stern 3, and a bottom 6 interconnecting the bow 2, stern 3 and side walls 4 and 5. It will be appreciated that the barge 1 is merely one example of the present invention. The barge 1 is a hopper barge, but the present invention covers any range of barges including, but not limited to, liquid barges, covered or deck barges, and open hopper barges.

With reference to FIG. 2, it will be seen that the bow 2 of the preferred embodiment of the present invention, when viewed along a longitudinal centerline plane of symmetry (lines 2—2, FIG. 1), presents a bow profile designated generally by the numeral 22. This bow profile 22 has a corresponding radius 23 associated therewith. In this preferred embodiment, the radius 23 has a value of about 14', as illustrated to scale (FIG. 2). The barge 1 having bow profile 22 characterized by a 14' radius 23 has a barge bow form fullness defined in terms of a block coefficient equaling about 0.976.

Figure 3:
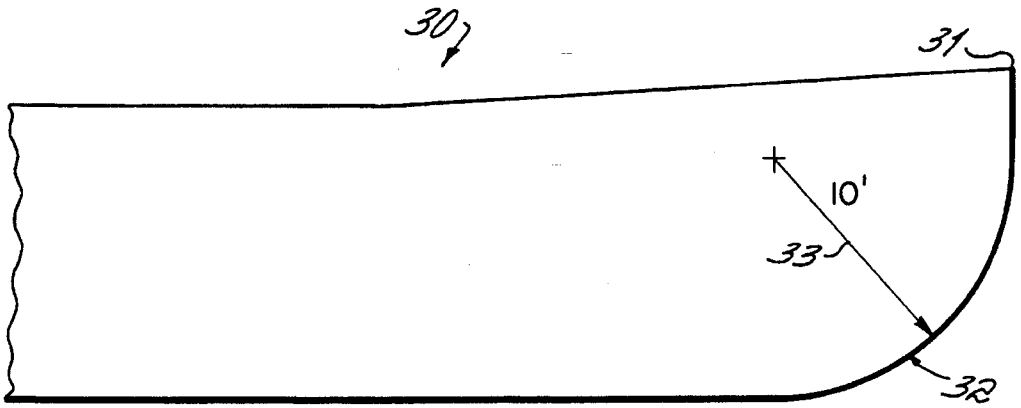
FIG. 3 is a view similar to FIG. 2 but illustrating the present invention of a barge having a 10' radius bow.
Figure 4:
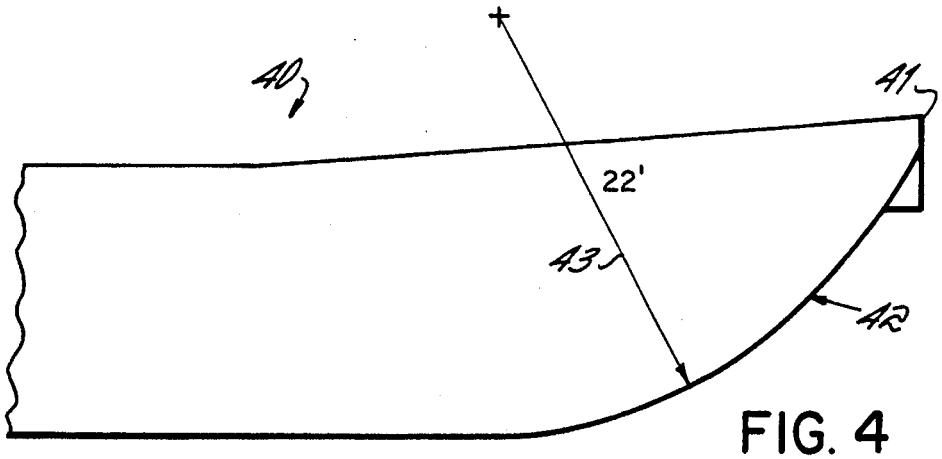
FIG. 4 is a view similar to FIG. 3 but illustrating the present invention of a barge having a 22' radius bow.

The barges 30 and 40 of FIGS. 3 and 4, respectively, represent barge bow radii within an acceptable range of economic efficiency. In FIG. 3 it will be noted that a barge 30 having a bow 31 exhibits a bow profile designated generally by the numeral 32, and has a corresponding radius 33 associated therewith of about 10'. The barge bow profile 32 of the barge 30 has a bow form fullness defined in terms of a block coefficient equal to about 0.988. The bow profile 32 of the barge 30 having a radius 33 of 10' constitutes the minimum economically efficient bow radius value in a range of values determined for the invention herein, as will be more fully developed hereafter.

In FIG. 4 there is illustrated a barge 40 having a bow 41 which exhibits a bow profile denoted generally by the numeral 42, and which has a radius 43 associated therewith of about 22'. The value of the radius 43 equalling 22' is at the uppermost end of the economically efficient range of bow radius values of the present invention. The barge 40 with bow profile 42 and radius 43 has a bow form fullness defined in terms of a block coefficient equalling about 0.96.

Figure 5:
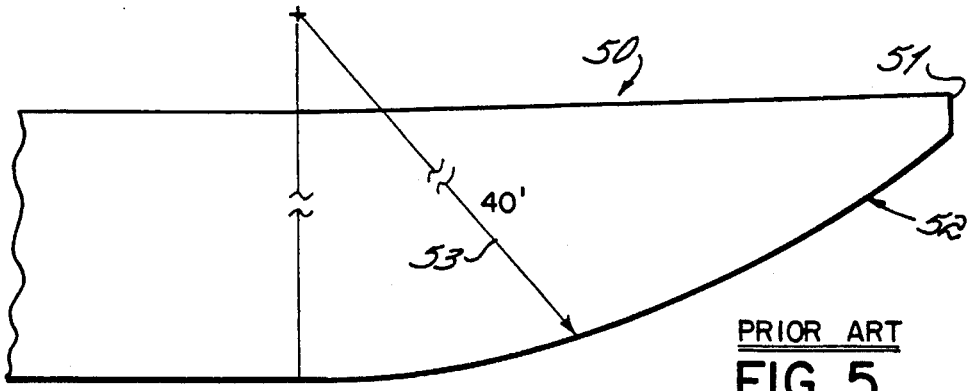
PRIOR ART FIG. 5
FIG. 5 is a view similar to FIG. 4 but illustrating the prior art barge having a 40' radius bow.

Referring now to FIG. 5, there is illustrated a barge 50 typical of the prior art. The barge 50 has a bow 51 which exhibits, generally, a bow profile 52, and has a radius 53 equal to about 40'. This prior art barge 50 having bow profile 52 characterized by a 40' radius 53 has a fullness defined in terms of a block coefficient equalling about 0.936.

B. The Methodology

It is well known that pushing a raked barge is more hydrodynamically efficient than pushing a square ended or box barge. The bow form of a raked barge reduces the resistance of the barge through water and thus saves fuel for a given speed, or allows increased speed for the same fuel burned. However, as the barge bow form becomes less "full" (more raked) and more hydrodynamically efficient, the barge becomes less buoyant due to the diminished underwater hull volume. Therefore the barge supports less weight at a given draft, and consequently has a reduced cargo carrying capacity. Simply stated, as barge bow form fullness decreases, the positive characteristics of less fuel consumed and/or greater speed attained are offset, in some amount, by the negative characteristic of less cargo carried. Conversely, as barge bow form fullness increases, the positive characteristic of more cargo carried is offset, in some amount, by the negative characteristics of more fuel consumed and/or less speed attained. Therefore, while a less full barge bow form is more hydrodynamically efficient, it does not necessarily follow that a more full barge bow form, while less hydrodynamically efficient, is less economically efficient. As will be developed subsequently in detail, it was determined that an optimum fullness exists for specific operating circumstances.

Figure 6:
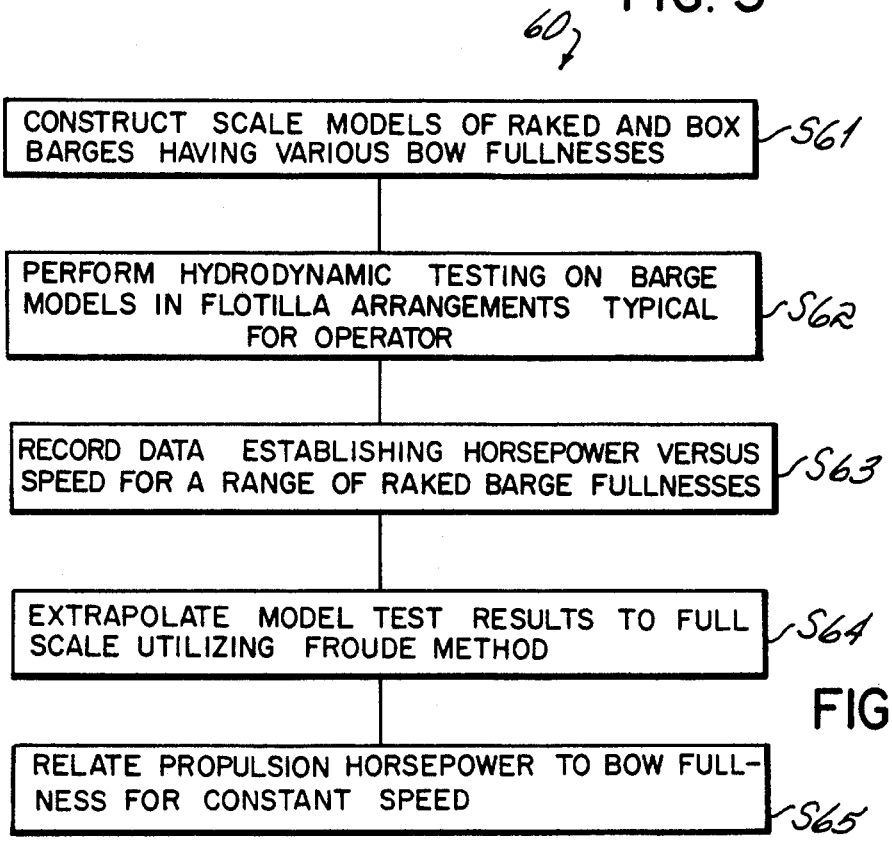
FIG. 6 is a block diagram outlining the steps taken in performing hydrodynamic testing on barge scale models.

Referring now to FIG. 6, there is illustrated a block diagram designated generally by the numeral 60 which illustrates the steps S61–S65 required to be performed as an initial task in determining the optimum 14' radius 23 of the barge 1.

Step S61 requires that a plurality of scale models of raked barges having various rakes, or bow radii, and of box barges, be constructed. Seventy 1:42 scale models of river barges were built for testing. The barge models consisted of box and semi-integrated (raked on one end and square or boxed on the other end) hulls. Three different rake radii were modeled which corresponded to 40', 22' and 10' full scale. The models were constructed of sugar pine and mahogany plywood coated inside and out with 3M 1706 protective coat as a sealant. The models were built as light as possible to allow testing at a scale 1.5' draft. Twenty scale models of each rake were built; additionally, ten box barge models were constructed.

Step S62 of the block diagram 60 is to perform hydrodynamic testing on the barge models (S61) in flotilla arrangements typical for the inland waterway operator. Essentially the flotilla arrangements or configurations are tested to compare the effects of changing the bow shape or radius of the raked barges in the flotilla. The flotilla arrangements or configurations, for comparison testing, were configured by varying the flotilla width via the number of barges, the flotilla length via the number of barges, and the number of loaded and empty barges in each flotilla configuration. Any portion of a flotilla may include the raked barge having the bow radii of the present invention, and the full benefit of the invention will be obtained.

Step S63 describes the next step in the testing process, namely the recordation of data during hydrodynamic testing of the barge models. The data preferably establishes horsepower to overcome resistance of the flotilla for each bow form (radius) for a range of flotilla velocities, and for flotilla configurations typical of the operator.

Step S64 involves the extrapolation of the model test results (S63) to full scale values utilizing the Froude method or other technically valid method. The Froude method separates resistance into two basic components: frictional ($R_f$) and residual ($R_r$). Froude extrapolations assume that the residual resistance coefficient ($C_r$) is constant between model and ship of the same Froude number, and that frictional resistance may be calculated based on the Reynolds number. All friction lines are based on fully turbulent flow so care must be taken to ensure that flow over the models is fully turbulent. Other technically valid methods of extrapolating model test results to full scale values could also be used.

Finally, step S65 instructs to relate propulsion horsepower to barge fullness for constant flotilla speed.

Figure 7:
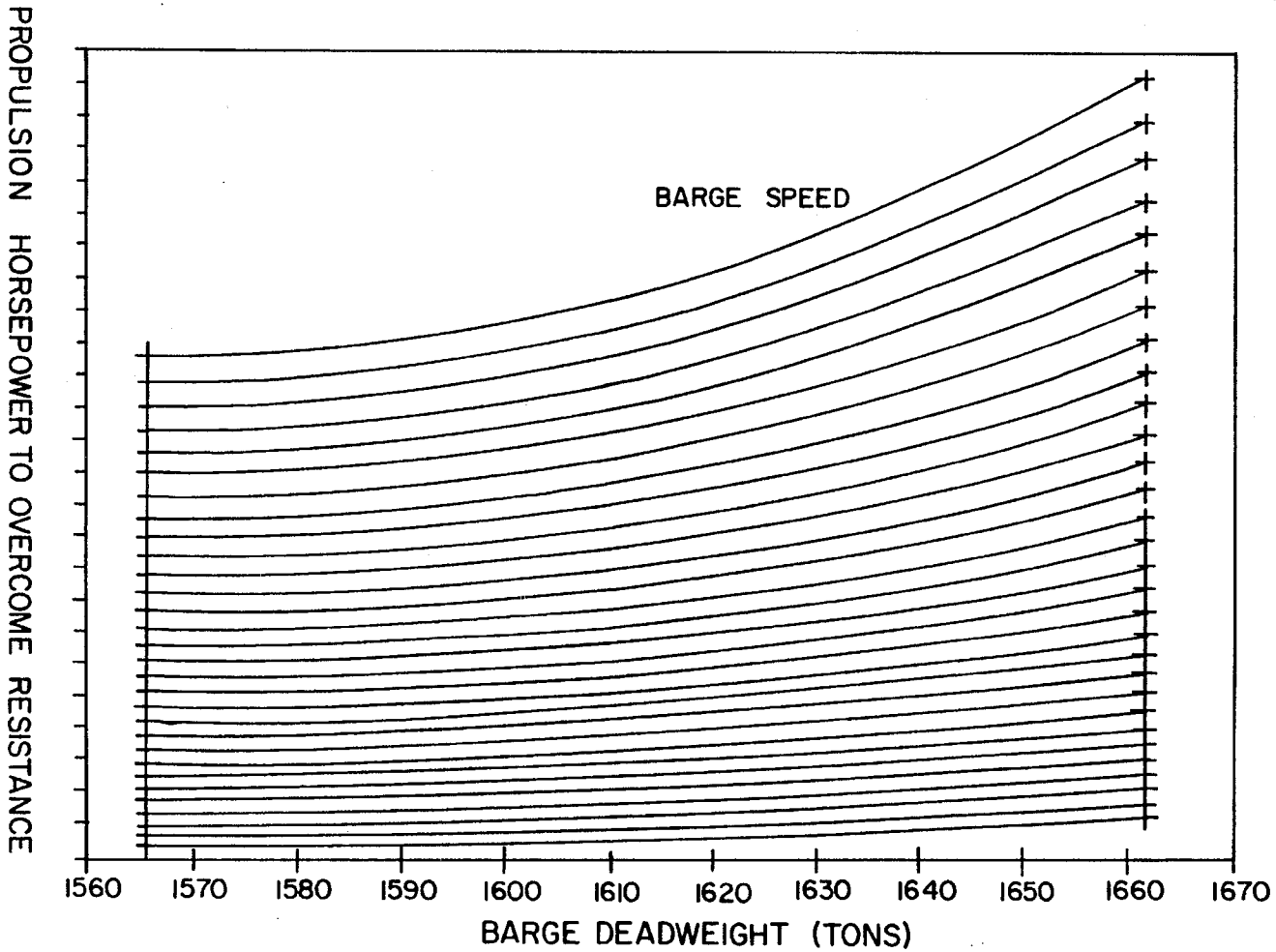
FIG. 7 is a typical graph of horsepower versus barge deadweight for a range of constant barge velocities generated from FIG. 6.

Referring now to FIG. 7, which depicts the result of step S65, there is illustrated a graph of horsepower to overcome flotilla resistance versus deadweight for constant velocity for a particular flotilla configuration, and typical of the graphs yielded by steps S61–S65 of the block diagram 60. Specifically, FIG. 7 was generated from data for three different flotillas, each flotilla being three barges wide by five barges long, with each barge loaded to a 9.25 ft. draft. The 40' radius bow barge corresponds to a barge deadweight of 1565 tons; therefore the data corresponding to the 3×5 flotilla where all of the raked barges have 40' bow radii is plotted at 1565 tons. The 22' radius bow barge corresponds to a barge deadweight of 1610 tons; similarly the data corresponding to the 3×5 flotilla where all of the raked barges have 22' bow radii is plotted at 1610 tons. And, the 10' radius bow barge corresponds to a barge deadweight of 1662 tons; therefore the data corresponding to the 3×5 flotilla where all of the raked barges have 10' bow radii is plotted at 1662 tons. Steps S61–S65, then, generate three data points for each flotilla configuration at a particular speed, with each data point corresponding to one of the three rake radii. Smooth curves are drawn through these three data points, as shown (FIG. 7), to generate a family of curves for use in further economic evaluations of the bow forms, as will be developed subsequently in detail.

It may be erroneously concluded from FIG. 6 that the barge bow form with the lowest absolute flotilla resistance (horsepower) is the best. While this may be true for ocean-going vessels that spend most of their time moving at a relatively high speed through the water with short times at slow speed, it has been found not to be true for inland waterway barges that spend much time at a very slow speed through the water. The best bow form for river work where average speed through the water over a route is very low has been determined only after careful analysis of actual flotilla speed, tons of cargo carried, and flotilla make-up. This analysis is applied to the model and extrapolated data yielded by the block diagram 60 to arrive at an economically optimum bow form and flotilla arrangement for a given set of circumstances, which will be more fully explained hereafter.

Figure 8:
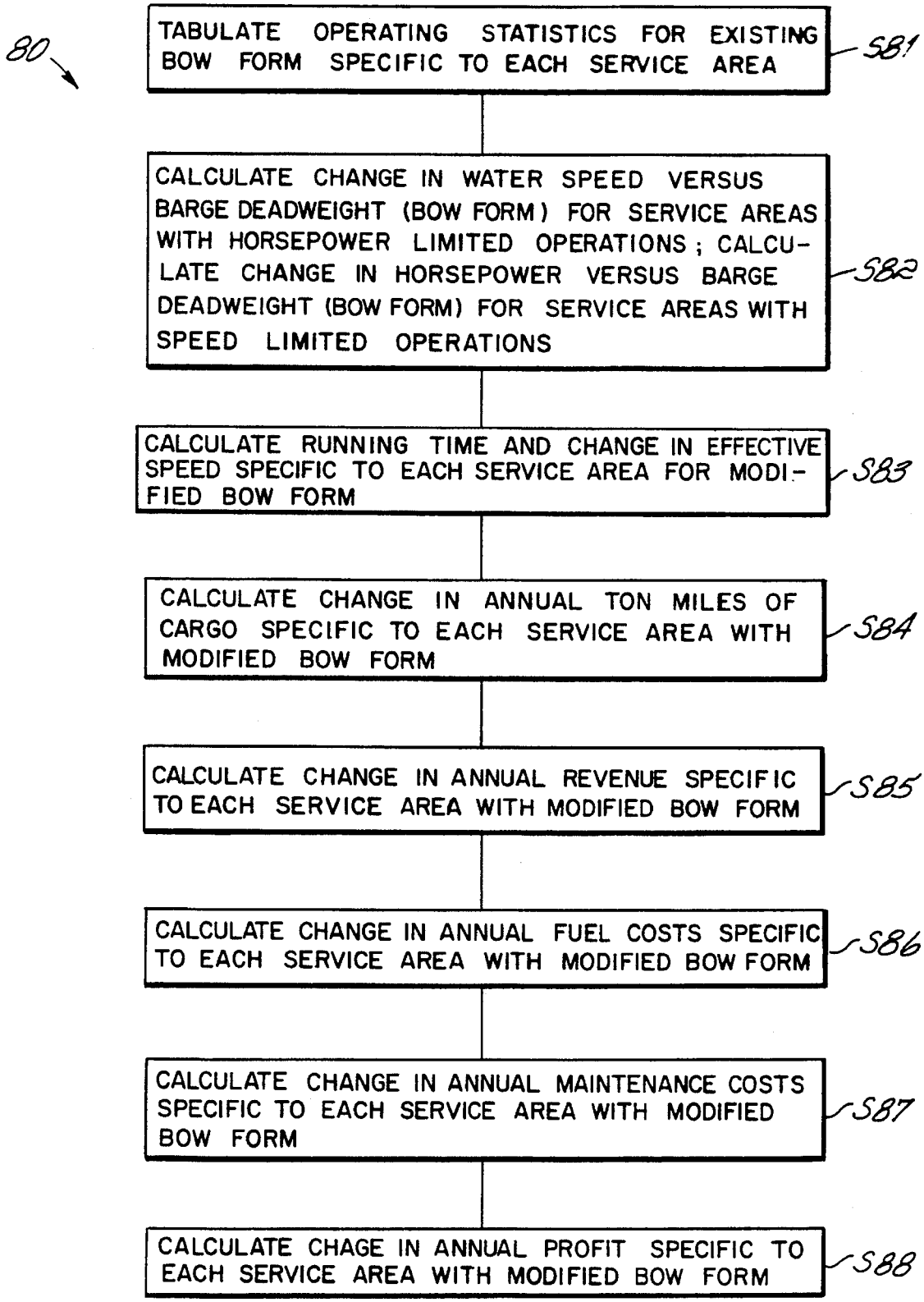
FIG. 8 is a block diagram outlining the steps for economic optimization which combine the results of FIG. 6 with operating data for the prior art barge having the bow profile of FIG. 5.

Accordingly, there is illustrated in FIG. 8, and denoted generally by the numeral 80, a block diagram outlining the steps S81–S88 required to arrive at an optimum bow form by applying the model and extrapolated data derived from FIG. 6 to a given set of inland waterway operating circumstances.

Step S81 requires tabulating operating statistics for an existing bow form (40' bow radius, the approximate existing industry standard) specific to each shipping or service area. The service areas chosen for the analysis were: the upper, middle and lower Mississippi rivers; the Illinois river; the Tennessee river; the East Intracoastal Canal and the upper and lower Ohio rivers. However, it will be appreciated that the present invention can be successfully practiced on any inland waterway in the world. Current operating statistics were tabulated for each of these service areas based upon the currently used 40' radius bow barge. The operating statistics included: running time upstream and downstream, speed over ground upstream and downstream, ratio of port/lock time to total operating time upstream and downstream, the number of loaded barges and empty barges in upstream and downstream flotillas, the effective overall flotilla speed, the total annual ton miles, fuel costs, speed through the water upstream and downstream, and speed of the river current. These operating statistics can vary for different operators and, therefore, produce different optimum results.

As illustrated in step S82, certain calculations may now be made. First, each service area must be categorized as either a horsepower limited operational area or a speed limited operational area. This step is based on the premise that operations in the various service areas fall into these two basic categories; namely those where flotilla speeds are limited by horsepower and those where flotilla speeds are limited by traffic, river or other economic conditions. In the horsepower limited operations, the speed through the water of the barge flotillas in these service areas is limited by the horsepower of the flotilla propelling boat. That is, the flotillas are able to operate at full power, and consequently, any increase in flotilla resistance due to changes in the bow form will result in a corresponding decrease in flotilla speed. The change in speed due to the change in flotilla resistance is calculated from the graphs of horsepower versus barge deadweight for constant barge velocity through the water, as derived from block diagram 60. Of the service areas chosen for analysis, the following service areas were selected to be included in the horsepower limited category: upper and lower Ohio rivers, lower Mississippi river, middle Mississippi river (downstream only), and the East Intracoastal Canal. However, the invention allows the selection of service areas to be horsepower limited or speed limited as appropriate to the operator.

With relation now to the speed limited operations, the speeds through the water of the barge flotillas in these service areas are limited by the river conditions; namely, traffic, bends in the river, river depth, river width, etc. or other economic factors such as speed reduction to conserve fuel. The boats are not operating at full power due to the constraints of the river or economic considerations, and consequently any increase in flotilla resistance due to changes in the bow form will result in an increase in both horsepower and fuel consumption required to maintain the same flotilla speed. In the speed limited service areas there is no change in speed through the water due to increased flotilla resistance. Therefore, for the speed limited service areas, all speeds are identical to those of the existing bow form regardless of the barge deadweight.

The additional horsepower required to maintain the same speed through the water as the flotilla resistance increases due to the change in bow form is calculated from the graphs of horsepower versus barge deadweight for constant barge velocity through the water, as derived from block diagram 60. While any of the service areas could be selected as speed limited, the service areas that were selected included: upper Mississippi river, middle Mississippi river (upstream only), the Illinois river, and the Tennessee river. Against this backdrop, the calculation of change in water speed versus change in barge deadweight may be performed.

Referring now to step S83, run times upstream and downstream, and the change in effective composite speed, specific to each service area for the modified bow form are calculated. First, speed over ground upstream and downstream for a specific service area for the modified bow form is calculated. The average speed over the ground equals the average speed through the water plus or minus the speed of the current for downstream and upstream operations, respectively. Next the relative change in total running time for a specific service area for the modified bow form is calculated. The relative change in total running time with the modified bow form is equal to the sum of the inverses of the upstream and downstream speeds over the ground with the modified bow form divided by the sum of the inverses of the upstream and downstream speeds over the ground for the existing bow form. Next the ratio of port/lock time to total operating time for a specific service area for a modified bow form is computed. In the dividend of this computation the port time hours up, down, or combined remain constant regardless of bow form. In the divisor, the relative change in running time is multiplied by the running time hours for the existing bow form to give the new running time hours. The new running time hours are then added to the port/lock time hours to give the new total operating time hours. From these values the effective composite speed for a service area with the modified bow form may be calculated, and finally the running hours upstream and downstream for the service area with the modified bow form are calculated.

Referring now to step S84, the change in annual ton miles of cargo specific to each service area with the modified bow form is now calculated.

Step S85 represents calculation of the change in annual revenue specific to each service area with the modified bow form.

Step S86 instructs to calculate the change in annual fuel costs specific to each service area with the modified bow form.

Step S87 instructs to calculate the change in annual maintenance and repair costs specific to each service area with the modified bow form.

Lastly, step S88 instructs to calculate the change in annual profit specific to each service area with the modified bow form.

Although the foregoing description of the economic optimization method used to arrive at the present invention will enable a person of ordinary skill in the art to make and use same, the following detailed methodology or flowchart listing is included. The listing provides detailed information concerning specific calculations and relationships corresponding to the steps S81–S88 of the block diagram 80. Additional detailed features of the system will become more apparent to those skilled in the art from reviewing the listing. Further, those skilled in the art will readily recognize the adaptability of this listing to programming for solution on a digital computer.

BOWFORM COMPARISON PROGRAM FLOWCHART

I. SERVICE AREA TABLE - CURRENT OPERATING STATISTICS STEP S81

A. This table contains operating statistics for the existing bowform specfic to each service area being considered.
B. The following operating statistics were obtained:
RTU1 Running time upstream (HOURS)
RTD1 Running time downstream (HOURS)
VGU1 Speed over ground upstream (MPH)
VGD1 Speed over ground downstream (MPH)
Note - Speed over the ground is based on running time only, excluding both port and locking time.
RPU1 Ratio of port/lock time to total operating time, upstream.
RPD1 Ratio of port/lock time to total operating time, downstream.
RP1 Ratio of port/lock time to total operating time, combined.
PTU Port/lock time, upstream (HOURS)
PTD Port/lock time, downstream (HOURS)

PTH Port/lock time, combined total (HOURS)
LDU # of loaded barges in upstream flotilla.
MTYU # of empty barges in upstream flotilla.
LDD # of loaded barges in downstream flotilla.
MTYD # of empty barges in downstream flotilla.
VE1 Effective overall boat speed (MPH) (i.e., total boat miles/total boat operating hours)
COEF4 Slope of the line relating brake horsepower to speed through the water (i.e., a decrease in speed through the water will result in an increase of horsepower). This is an engineering relationship.
TM Total annual ton miles by service area.
FC Fuel cost per gallon including usertax ($per gallon)
VWU1 Speed through the water upstream (MPH)
VWD1 Speed through the water downstream (MPH)
VC Speed of the river current (MPH)
Note - Values detremined by simultaneously solving the three following equations for VWU, VWD, and VC:

$VGU1 = C1 \times VWU - VC$
$VGD1 = C2 \times VWD + VC$
$VWU1 = C3 \times VMD$

And substituting those values into the following equations:

$VWU1 = C1 \times VWU$
$VWD1 = C2 \times VWD$

Where:
C1 & C2 are relative vessel utilization factors for upstream and downstream operations, respectively, for the particular service area.
C3 is a coefficient determined from the model test data based on the resistance of the upstream and downstream flotilla configurations of the particular service area.
VWU and VWD are the speeds through the water upstream and downstream, respectively, for a particular service area, with the existing bowform, at 100% vessel power.

II. DATA TABLE FOR WATER SPEED vs. CHANGE IN BARGE DEADWEIGHT STEP S82

The formulation of this table is based on the premise that operations in the various service areas fall into two basic categories, those where flotilla speeds are limited bt horsepower and those where flotilla speeds are limited by speed or river conditions, as follows:

A. HORSEPOWER LIMITED OPERATIONS:

1. The speed through the water of the barge flotillas in these service areas are limited by the horsepower of the boat, i.e., the boats are operating at full power, consequently, any increase in flotilla resistance due to changes in the bowform will result in corresponding decrease in flotilla speed through the water.
2. The change in speed through the water due to the change in flotilla resistance has been calculated from the graphs of horsepower vs. barge deadweight tons, for various speeds through the water derived from the model test data (see II. C. for procedure).
3. Service areas included in the horsepower limited category are as follows:
   a. Upper Ohio River
   b. Lower Ohio River
   c. Lower Mississippi River (see note following)
   d. East Canal
   e. Mid Mississippi River - Downstream

B. SPEED LIMITED OPERATIONS:

1. The speed through the water of the barge flotillas in these service areas are limited by the river conditions (i.e., traffic, bends, river depth, river width, etc.). The boats are not operating at full power due to the constraints of the river, consequently, any increase in flotilla resistance due to changes in the bowform will result in an increase in boat horsepower and fuel consumption required to maintain the same flotilla speed.

2. In speed limited service areas there is no change in speed through the water due to increased flotilla resistance, consequently, for the speed limited service areas, all speeds in this table are identical to those of the existing bowform, VWU1 or VWD1, regardless of barge deadweight.
3. The additional horsepower required to maintain the same speed through the water, as the flotilla resistance increases due to the change in bowform, is provided in a separate table "DATA TABLE FOR CHANGE IN BRAKE HORSEPOWER vs. CHANGE IN BARGE DEADWEIGHT FOR SPEED LIMITED SERVICE AREAS." Note - This horsepower change has been calculated from the graphs of horsepower vs. barge deadweight tons, for various speeds through the water, derived from the model test data (see II. D. for procedure).
4. Service areas included in the speed limited category are as follows:
   a. Upper Mississippi River
   b. Mid Mississippi River - Upstream
   c. Illinois River
   d. Tennessee River C. CALCULATION OF CHANGE IN WATER SPEED vs. CHANGE IN BARGE DEADWEIGHT For service areas with horsepower limited operations the speed through the water for the various barge deadweights are determined by reading the data points from the graphs of flotilla resistance (horsepower) vs. barge deadweight (tons), for various speeds through the water, derived from the model test data, according to the following procedure:

1. Select the appropriate graph for the two characteristic (towsize, loads & empties) of the service area being considered taking into account flotilla direction (upstream or downstream) from one of three graphs as given below:
   CONFIGURATION'S 2, 4 & 5 - 15 BARGE LOADED TOW
   CONFIGURATION'S 32, 37 & 38 - 14 BARGE MIXED TOW
   CONFIGURATOON'S 8, 9 & 10 - 30 BARGE LOADED TOW
2. From the graph determine the horsepower corresponding to the water speed of the flotilla with the existing bowform (speed = VWU1 or VWD1, deadweight = approximately 1565 tons). This intersection point of horsepower and deadweight will be defined as the "Left Index Pont."
3. From the graph determine the water speed at the horsepower calculated in 2 above for barge deadweight = approximately 1662 tons.
4. Calculate the difference in speed by subtracting the speed at 1662 tons from that at 1565 tons. Multiply this by 50 and add the result to the horsepower of the existing bowform as calculated in 2 above. This intersection point of the resulting horsepower and deadweight = 1662 tons will be defined as the "Right Index Point."
5. On the graph, draw a straight line connecting the right and left index points. This line will be defined as the "Index Line." Water speed for a particular barge deadweight is calculated by interpolation of the speed curves at the intersection point of the barge deadweight and the index line.

D. CALCULATION OF CHANGE IN BRAKE H.P. vs. CHANGE IN BARGE DEADWEIGHT

For service areas with speed limited operations, the increase in brake horsepower required to maintain, the same speed through the water for the various barge deadweights are determined by reading the data points from the graphs of flotilla resistance (push horsepower) vs. barge deadweight (tons), for various speeds through the water, derived from the model test data, according to the following procedure:

1. Select the appropriate graph for the flotilla characteristics (towsize, loads & empties) of the service area being considered taking into account flotilla direction (upstream or downstream) from one of three graphs as given below:
   CONFIGURATION'S 2, 4 & 5 - 15 BARGE LOADED TOW
   CONFIGURATION'S 32, 37 & 38 - 14 BARGE MIXED TOW
   CONFIGURATION'S 8, 9 & 10 - 30 BARGE LOADED TOW
2. On the graph select the constant speed curve which is closest to the water speed of the flotilla with the existing bowform (speed = VWU1 or VWD1).
3. Determine the horsepower for each barge deadweight by reading the horsepower value at the intersection of this constant speed curve and the barge deadweight. Calculate the change in horsepower by subtracting the horsepower of the existing bowform (barge deadweight = 1564.67 tons) from the horsepower of the new barge deadweight. This is the change in push horsepower required to maintain the same flotilla speed at the new deadweight.
4. Multiply the change in push horsepower by a factor to convert into brake horsepower.

III. ENGINEERING EQUATIONS STEP S83

A. SPEED OVER GROUND UPSTREAM & DOWNSTREAM FOR SPECIFIC SERVICE AREA FOR MODIFIED BOWFORM (VGU2, VGD2 in MPH)

VGU2 = VWU2 − VC

VGD2 = VWD2 + VC

The average speed over the ground equals the average speed through the water plus or minus the speed of the current for downstream and upstream operations, respectively.

B. RELATIVE CHANGE IN TOTAL RUNNING TIME FOR A SPECIFIC SERVICE AREA FOR MODIFIED BOWFORM (W)

$$W = \frac{1/VGU2 + 1/VGD2}{1/VGU1 + 1/VGD1}$$

The relative change in total running time with the modified bowform is equal to the sum of the inverse's of the upstream and downstream speeds over the ground with the modified bowform divided by the sum of the inverse's of the upstream and downstream speeds over the ground for the existing bowform.

NOTE - The relative change in running time, upstream and downstream, with the modified bowform are calculated in a similar manner. The relative change in running time (up or down) is equal to the inverse of the speed over ground (up or down) for the modified bowform divided by the inverse of the speed over ground (up or down) for the existing bowform. These values are utilized in the calculation of RPU2 and RPD2 in III. C. below.

C. RATIO OF PORT/LOCK TIME TO TOTAL OPERATING TIME FOR SPECIFIC SERVICE AREA FOR MODIFIED BOWFORM (UPSTREAM--- RPU2, DOWNSTREAM--- RPD2, COMBINED--- RP2)

$$RPU2 = \frac{PTU}{((1/VGU2)/(1/VGU1)) * (PTU/RPU1 - PTU) + PTU}$$

$$RPD2 = \frac{PTD}{((1/VGD2)/(1/VGD1)) * (PTD/RPD1 - PTD) + PTD}$$

-continued

BOWFORM COMPARISON PROGRAM FLOWCHART $$PR2 = \frac{PTH}{(W) * (PTH/RP1 - PTH) + PTH}$$

DIVIDEND - The port time hours up, down, or combined remain constant regardless of the bowform.

DIVISOR - The relative change in running time is multiplied by the running time hours for the existing bowform to give the new running time hours. The new running time hours are then added to the port/lock time hours to give the new total operating time hours.

D. EFFECTIVE COMPOSITE SPEED FOR SERVICE AREA WITH MODIFIED BOWFORM (VE2 in MPH)

$$VE2 = \frac{2}{(1 + (RP2)/(1 - RP2)) * ((1/VGU2) + (1/VGD2))}$$

E. RUNNING TIME HOURS UPSTREAM AND DOWNSTREAM FOR SERVICE AREA WITH MODIFIED BOW (RTU2, RTD2)

$$RT_2 = \begin{bmatrix} \text{TOTAL OPERATING} \\ \text{HOURS FOR EXISTING} \\ \text{OR NEW BOWFORM} \end{bmatrix} * \begin{bmatrix} \text{RATIO OF RUNNING} \\ \text{TIME TO TOTAL} \\ \text{OPERATING TIME} \end{bmatrix}$$

RTU2 = ( PTU / RPU1 )*( 1 − RPU2 )
RTD2 = ( PTD / RPD1 )*(1 − RPD2 )

NOTE Running times for the modified bow are based on a constant cycle time, i.e., total operating time for both the existing and modified bow are the same, with the slower speeds resulting in a lower ratio of port time to total operating time, or simply, a greater percentage of the cycle is spent running when operating at slower speeds.

IV. ECONOMIC EQUATIONS:

A. CHANGE IN TON MILES PER YEAR FOR SERVICE AREA WITH MODIFIED BOWFORM ( CTM in TON MILES / YEAR ) STEP S84

$$CTM + \begin{bmatrix} \text{TON MILES} \\ \text{FOR SA WITH} \\ \text{EXISTING BOW} \end{bmatrix} * \left[ 1 + \left[ \frac{\text{\# RAKES * DEADWEIGHT of RAKE}}{(\text{\# RAKES * DEADWTrake}) + (\text{\# BOXES * DEADWTbox})} \right] * \left[ \frac{\text{BARGE DEADWT MODIFIED BOW}}{\text{BARGE DEADWT EXISTING BOW}} - 1 \right] \right] *; \left[ \frac{\text{EFFECTIVE BOAT SPEED FOR SA WITH MODIFIED BOW}}{\text{EFFECTIVE BOAT SPPED FOR SA WITH EXISTING}} \right] - \begin{bmatrix} \text{TON MILES} \\ \text{FOR SA WITH} \\ \text{EXISTING BOW} \end{bmatrix}$$

$$CTM = \left[ \frac{(TM) * [1 + (0.6509) * (PCBD * 0.01)] * (VE2)}{VE1} \right] - [TM]$$

B. CHANGE IN TOTAL REVENGE PER YEAR FOR SERVICE AREA WITH MODIFIED BOW ( CTR in $'s / YEAR ) STEP S85.

$$CTR = [\text{REVENUE PER TON MILE}] * \begin{bmatrix} \text{CHANGE IN TON MILES PER YEAR} \\ \text{FOR SERVICE AREA} \\ \text{WITH MODIFIED BOWFORM} \end{bmatrix}$$

C. CHANGE IN FUEL COST PER YEAR FOR SERVICE AREA WITH MODIFIED BOWFORM ( CFC in $'s / YEAR ) STEP S86

$$CFC = \begin{bmatrix} \text{FUEL} \\ \text{COST} \\ \$/\text{gal} \end{bmatrix} * \begin{bmatrix} \text{RATED SPECIFIC} \\ \text{FUEL CONSUMPTION} \\ (\text{gals/HP/hour}) \end{bmatrix} * \left[ \left[ \begin{bmatrix} \text{CHANGE IN HP} \\ \text{REQUIRED TO} \\ \text{MAINTAIN} \\ \text{SPEED UP} \\ (\text{Speed lim}) \end{bmatrix} + \begin{bmatrix} \text{CHANGE IN} \\ \text{HP DUE TO} \\ \text{CHANGE IN} \\ \text{SPPED UP} \\ (\text{HP lim}) \end{bmatrix} \right] * \begin{bmatrix} \text{RUN} \\ \text{TIME} \\ \text{HOURS} \\ \text{UP} \end{bmatrix} + \left[ \left[ \begin{bmatrix} \text{CHANGE IN HP} \\ \text{REQUIRED TO} \\ \text{MAINTAIN} \\ \text{SPEED DOWN} \\ (\text{Speed lim}) \end{bmatrix} + \begin{bmatrix} \text{CHANGE IN} \\ \text{HP DUE TO} \\ \text{CHANGE IN} \\ \text{SPEEDDOWN} \\ (\text{HP lim}) \end{bmatrix} \right] * \begin{bmatrix} \text{RUN} \\ \text{TIME} \\ \text{HOURS} \\ \text{DOWN} \end{bmatrix} \right]$$

CFC = (FC)*(0.054)*[[CHPU + (COEF4)*(VWU1−VWU2)]*(RTU2) + [CHPD + (COEF4)*(VWD1−VWD2)]*(RTD2)]

-continued

BOWFORM COMPARISON PROGRAM FLOWCHART

D. CHANGE IN MAINTENANCE COST PER TEAR FOR SERVICE AREA WITH MODIFIED BOWFORMN ( CMC in $'s / YEAR ) STEP S87

$$CMC = \left[\begin{array}{c}\text{TOTAL}\\ \text{ANNUAL}\\ \text{PROPULSION}\\ \text{RELATED}\\ \text{M\&R COST}\end{array}\right] * \left[\frac{\begin{array}{c}\text{RUNNING TIME HOURS FOR SERVICE}\\ \text{AREA WITH EXISTING BOWFORM}\end{array}}{\begin{array}{c}\text{RUNNING TIME HOURS FOR ALL SERVICE}\\ \text{AREAS WITH EXISTING BOWFORM}\end{array}}\right] \left[\frac{\begin{array}{c}\text{RUNNING TIME HOURS FOR SERVICE}\\ \text{AREA WITH MODIFIED BOWFORM}\end{array}}{\begin{array}{c}\text{RUNNING TIME HOURS FOR SERVICE}\\ \text{AREAS WITH EXISTING BOWFORM}\end{array}} - 1\right]$$

$$CMC = \left[\begin{array}{c}\text{TOTAL}\\ \text{ANNUAL}\\ \text{PROPULSION}\\ \text{RELATED}\\ \text{M\&R COST)}\end{array}\right] * \left[\frac{RTU1 + RTD1}{RTUS + RTDS}\right] * \left[\frac{RTU2 + RTD2}{RTU1 + RTD1} - 1\right]$$

E. CHANGE IN PROFIT PER YEAR FOR SERVICE AREA WITH MODIFIED BOWFORM (CP in $'s / YEAR ) STEP S88

CP = [CHANGE IN REVENUE] − [CHANGE IN FUEL COST] − [CHANGE IN MAINTENANCE COST]

CP = CTR − CFC − CMC

C. The Economically Optimum Bow Form

Figure 9:
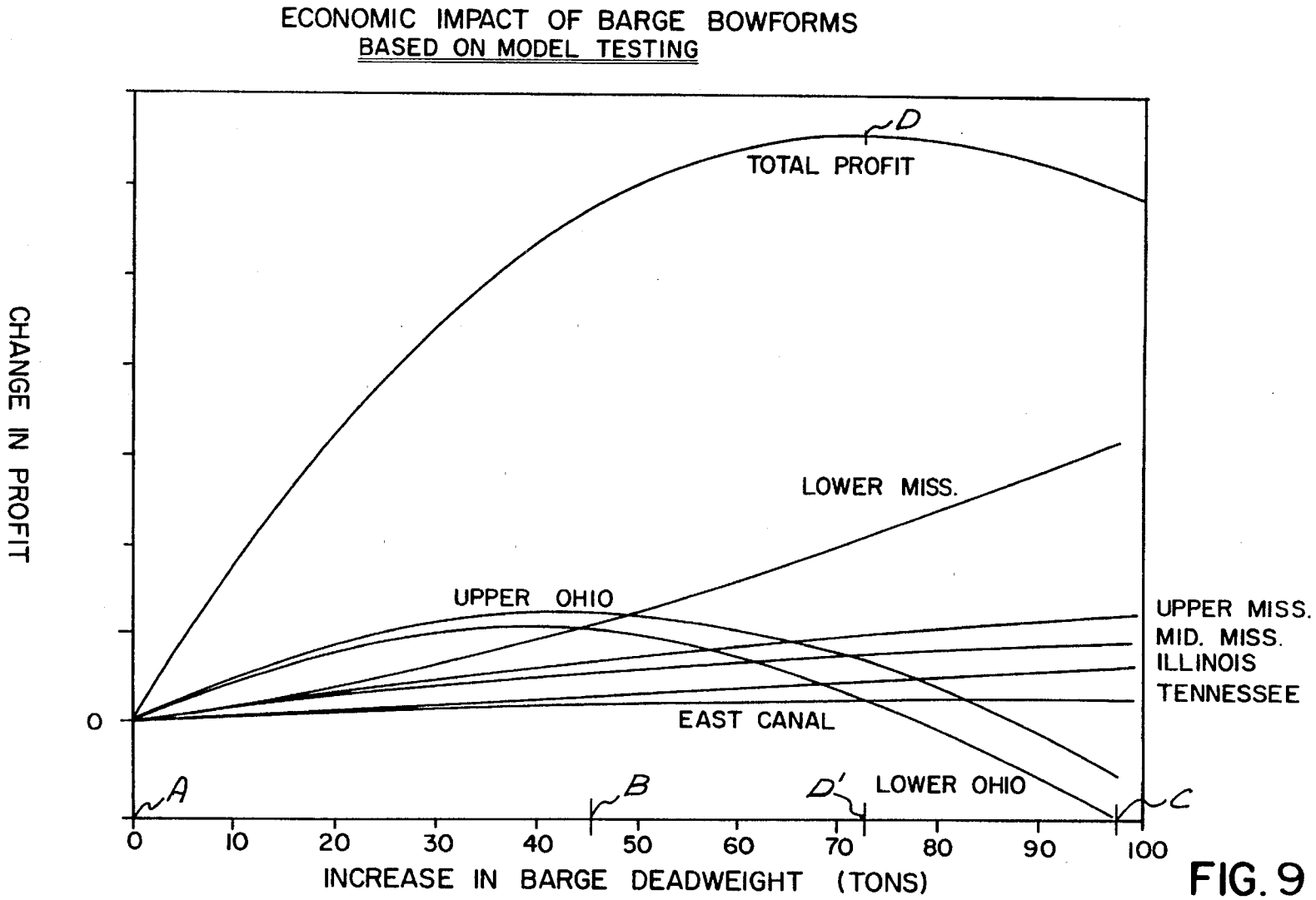
FIG. 9 is a plot of a typical change in profit versus change in deadweight generated by combining FIGS. 6 and 8 for selected service areas of U.S. inland waterways and for the composite of all service areas.

Referring now to FIG. 9, there is illustrated the change in profit inuring to the benefit of the barge operator versus increase in barge deadweight in tons as generated by the steps S81–S88 of the block diagram 80. On the abscissa, the 0 ton increase location A corresponds to the prior art 40' radius bow barge, the 22' radius bow barge corresponds to an increase in barge deadweight of approximately 45 tons at B and the 10' radius bow barge corresponds to an increase in barge deadweight of approximately 97 tons at C (40' radius bow barge corresponds to a barge deadweight of 1565 tons; 22' radius bow barge corresponds to a barge deadweight of 1610 tons; 10' radius bow barge corresponds to a deadweight of 1662 tons). The total profit curve is a composite, or sum of the 8 service area profit curves.

Figure 10:
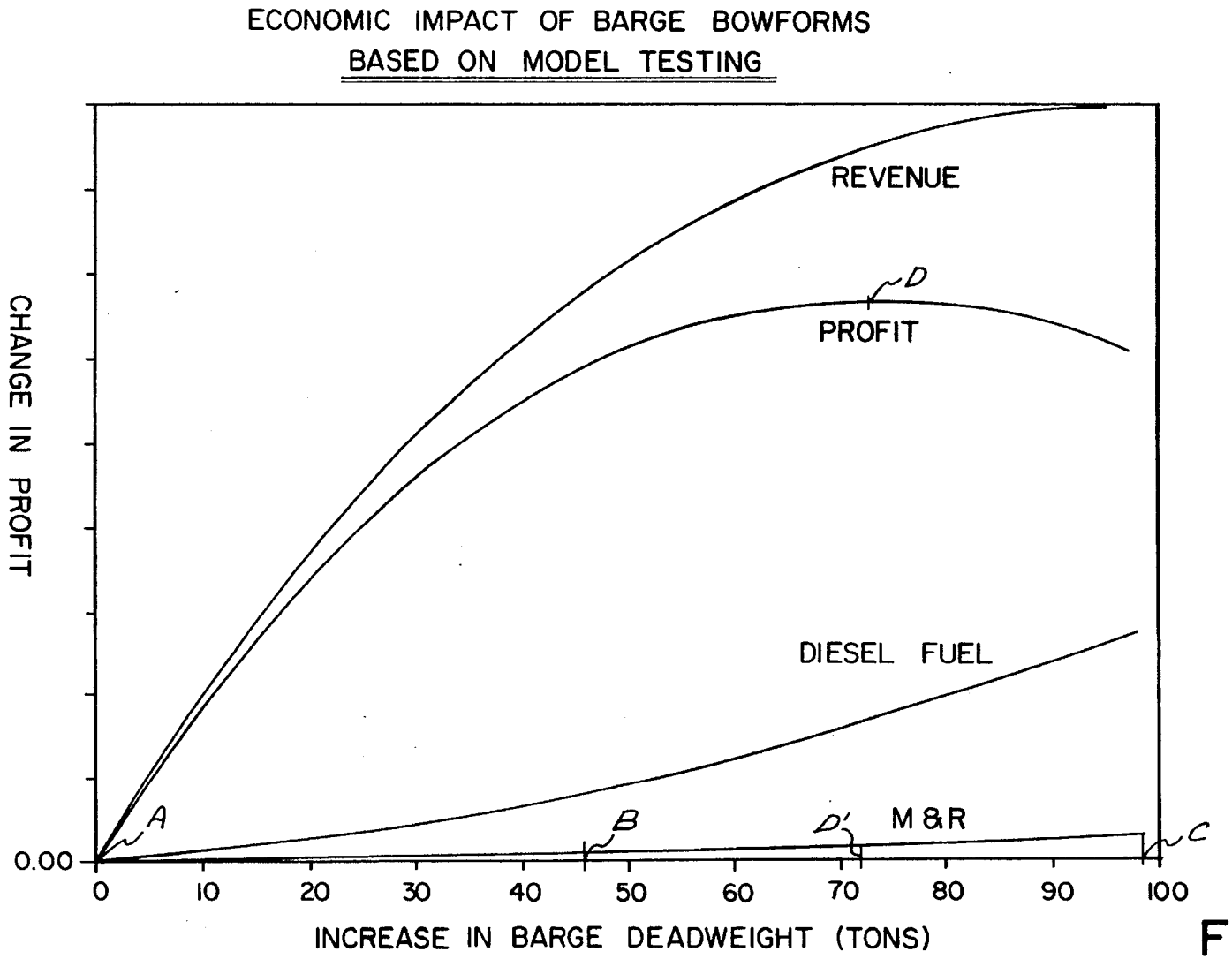
FIG. 10 is a plot of change in revenue, profit, fuel costs, and maintenance and repair costs versus change in barge deadweight for the service areas and composite of FIG. 9.

Referring now to FIG. 10, there is illustrated the composite change in revenue, profit, fuel costs and maintenance and repair costs versus barge deadweight in tons as generated by block diagram 80.

From the total profit curve of FIG. 9 (or the profit curve of FIG. 10), there will be observed a maximum at D (where the slope of the curve equals zero) at an increase in barge deadweight of approximately 72 tons, denoted D'. Based upon the geometric relationship between barge deadweight, buoyancy or volume of displacement, and bow fullness, it was determined that this maximum D at 72 tons increase in deadweight D' corresponds to a barge bow radius of approximately 14'. Correspondingly, a barge having a 14' radius bow has a fullness defined in terms of a block coefficient equalling approximately 0.976 (FIGS. 1 and 2). This barge (FIGS. 1 and 2), then, is economically optimum for the composite of the service areas and operating statistics considered.

Referring to FIG. 9, it was observed that the relatively large benefit of greater fullness on the lower Mississippi River service area was due, in this application, to the relatively large amount of ton miles of cargo shipped and the fact that, for the most part, loaded barges travel south with the current and empty barges travel north against the current. Furthermore, bow fullness has a very small impact on empty barge operation. In addition, the Ohio river service areas indicate a less full optimum bow than the other service areas. This is because of relatively higher speeds, in this application, on the Ohio, which indicates high horsepower per flotilla size. In other applications, the characteristics of the curves could differ somewhat. It should further be noted that changes in fuel prices should have little effect on the optimum bow fullness, or the associated benefits. Gradual changes in fuel prices should be matched by corresponding changes in revenue via open market rates and contract escalation agreements.

In order to close the model testing, economic analysis, and optimum bow radius selection loop (FIGS. 6, 8 and 9), it is preferred that the selected optimum radius (from FIG. 9) be tested to confirm block diagram 60 (FIG. 6). Once full scale results are extrapolated from the model test data, these figures can be fed into block diagram 80 in order to confirm the net change in revenues predicted.

Those skilled in the art will readily recognize adaptations and modifications which can be made to the present invention and which will result in an improved barge, methods of use thereof, and shipping therein, without departing from the spirit or the scope of the present invention, as defined by the following claims.

What is claimed is:

1. A barge for the commercial shipping of cargo along an inland waterway having:

a bow, a stern, elongated sidewalls extending between said bow and stern, a bottom interconnecting said bow, stern, and sidewalls, and a longitudinal centerline plane therealong;

said bow having a profile within said centerline plane defined by a fullness with a corresponding radius, said fullness defined by a block coefficient, said fullness and radius optimized for economic performance of said barge, said block coefficient ranging from 0.96 to 0.988 and said corresponding radius ranging from 10' to 22'.

2. The barge of claim 1 wherein said economic performance depends upon:

revenue generated by shipping said cargo in said barge along said waterway, fuel costs associated with overcoming resistance to propel said barge along said waterway, and maintenance and repair costs associated with propelling said barge along said waterway.

3. The barge of claim 1 wherein said block coefficient is 0.976 and said corresponding radius is 14'.

4. A barge for the commercial shipping of cargo along an inland waterway having:

a bow, a stern, elongated sidewalls extending between said bow and stern, a bottom interconnecting said bow, stern, and sidewalls, a longitudinal centerline plane therealong, and a capacity therein;

said bow having a profile within said centerline plane defined by a fullness with a corresponding radius, said fullness defined by a block coefficient, said fullness and radius optimized for economic performance of said barge along said waterway, said block coefficient ranging from 0.96 to 0.988 and said corresponding radius ranging from 10' to 22', said fullness and radius optimized, by evaluating:

said barge capacity, barge speed attained along said waterway, propulsion horsepower required to overcome barge resistance to traverse said waterway, barge running time required to traverse said waterway, fuel costs required to overcome barge resistance to traverse said waterway, and propulsion maintenance and repair costs required to traverse said waterway.

5. The barge of claim 4 wherein said barge capacity is tonnage.

6. The barge of claim 4 wherein said block coefficient is 0.976 and said corresponding radius is 14'.

7. The barge of claim 4 wherein said barge speed ranges up to about 15 mph.

8. The barge of claim 4 wherein said barge capacity is deadweight.

9. A barge for the commercial shipping of cargo along an inland waterway having:

a bow, a stern, elongated sidewalls between said bow and stern, a bottom interconnecting said bow, stern, and sidewalls, and a longitudinal centerline plane therealong;

said bow having a profile within said centerline plane defined by a fullness with a corresponding radius, said fullness defined by a block coefficient, said fullness and radius optimized to provide a capacity for said barge and a resistance to movement along said waterway for said barge such that revenue generated by shipping said cargo in said barge less a sum of fuel costs associated with overcoming resistance to propel said barge along said waterway and maintenance and repair costs associated with propelling said barge along a waterway is maximized, said block coefficient ranging from 0.96 to 0.988 and said corresponding radius ranging from 10' to 22'.

10. The barge of claim 9 wherein said barge capacity is tonnage.

11. The barge of claim 9 wherein said barge capacity is deadweight.

12. The barge of claim 9 wherein said block coefficient is about 0.976 and said corresponding radius is about 14'.

13. The barge of claim 9 wherein said barge traverses said waterway at a speed ranging up to about 15 mph.

14. A plurality of barges configured into a flotilla, said flotilla being generally N barges wide by M barges long and including either all raked barges or a combination of raked and box barges, at least one raked barge having:

a bow, a stern, elongated sidewalls between said bow and stern, a bottom interconnecting said bow, stern and sidewalls, and a longitudinal centerline plane therealong;

said bow having a profile within said centerline plane defined by a fullness with a corresponding radius, said fullness defined by a block coefficient, said block coefficient ranging from 0.96 to 0.988 and said corresponding radius ranging from 10' to 22' said fullness and radius optimized to provide a capacity based upon deadweight or tonnage for said flotilla and a resistance to movement along said waterway for said flotilla such that revenue generated by shipping said cargo in said flotilla less a sum of fuel costs associated with overcoming resistance to propel said flotilla along said waterway at speeds up to about 15 mph and maintenance and repair costs associated with propelling said flotilla is maximized.

15. The flotilla of claim 14 wherein said block coefficient is about 0.976 and said corresponding radius is about 14'.

16. A method of shipping cargo in a barge along an inland waterway comprising:

providing at least one barge having a bow with an optimum profile defined by a fullness with a corresponding radius within a centerline plane of symmetry of said barge, said fullness defined by a block coefficient, said block coefficient ranging from 0.96 to 0.988 and said corresponding radius ranging from 10' to 22', loading cargo into said barge having said optimum bow radius and block coefficient, and propelling said barge along said waterway with fuel consuming propulsion means.

17. The method of claim 16 wherein said barge has an existing bow defined by a present approximate fullness with a corresponding present approximate radius, said present fullness defined by a present approximate block coefficient, and wherein said optimum fullness having an optimum radius and defined by an optimum block coefficient corresponds to a modified bow, said optimum block coefficient and radius determined by:

determining a difference in revenue based upon a difference in deadweight shipped at a modified speed in said barge along said waterway with said modified bow and deadweight shipped in said barge along said waterway with said existing bow at a present speed, determining a difference in fuel costs based upon differences in horsepower and run time required to traverse said waterway in said barge with said modified bow and horsepower and run time required to traverse said waterway in said barge with said existing bow, determining a difference in maintenance and repair costs based upon a difference in run time required to traverse said waterway in said barge with said modified bow and run time required to traverse said waterway in said barge with said existing bow, and comparing said changes in revenue, fuel costs, and maintenance and repair costs.

18. The method of claim 17 wherein said barge capacity is tonnage.

19. The method of claim 17 wherein said block coefficient is about 0.976 and said corresponding radius is about 14'.

20. The method of claim 17 wherein said barge is propelled at a speed ranging up to about 15 mph.

21. The method of claim 17 wherein said barge capacity is deadweight.

22. A plurality of barges configured into a flotilla, said flotilla being generally N barges wide by M barges long and including either all raked barges or a combination of raked barges and box barges, at least one raked barge having:

a bow, a stern, elongated sidewalls extending between said bow and stern, a bottom interconnecting said bow, stern, and sidewalls, a longitudinal centerline plane therealong, and a capacity based upon deadweight or tonnage therein;

said bow having a profile within said centerline plane defined by a fullness with a corresponding radius, said fullness defined by a block coefficient, said block coefficient ranging from 0.96 to 0.988 and said corresponding radius ranging from 10' to 22', said fullness and radius optimized for economic performance of said barge along said waterway at speeds up to about 15 mph by evaluating:

said barge capacity, barge speed attained along said waterway, propulsion horsepower required to overcome flotilla resistance to traverse said waterway, flotilla running time required to traverse said waterway, fuel costs required to overcome flotilla resistance to traverse said waterway, and propulsion maintenance and repair costs required to traverse said waterway.

23. The flotilla of claim 22 wherein said block coefficient is about 0.976 and said corresponding radius is about 14'.

24. A plurality of barges configured into a flotilla, said flotilla being generally N barges wide by M barges long and including either all raked barges or a combination of raked and box barges, at least one raked barge having:

a bow, a stern, elongated sidewalls extending between said bow and stern, a bottom interconnecting said bow, stern, and sidewalls, and a longitudinal centerline plane therealong;

said bow having a profile within said centerline plane defined by a fullness with a corresponding radius, said fullness defined by a block coefficient, said fullness and radius optimized for economic performance of said barge, said block coefficient ranging from 0.96 to 0.988 and said corresponding radius ranging from 10' to 22', said economic performance dependent upon:

revenue generated by shipping said cargo in said barge along said waterway, fuel costs associated with overcoming resistance to propel said barge along said waterway, and maintenance and repair costs associated with propelling said flotilla.

25. The flotilla of claim 24 wherein said block coefficient is about 0.976 and said corresponding radius is about 14'.

* * * * *

UNITED STATES PATENT AND TRADEMARK OFFICE

CERTIFICATE OF CORRECTION

PATENT NO. : 5,488,918

DATED : February 6, 1996

INVENTOR(S) : Fontain M. Johnson, Jr., and Jerry M. Williams

It is certified that error appears in the above-indentified patent and that said Letters Patent is hereby corrected as shown below:

| | |
|---|---|
| Column 9, line 15, "($per gallon) | should be --($'s per gallon) |
| Column 9, line 19, "detremined" | should be --determined-- |
| Column 9, line 24, "VMD" | should be --VWD-- |
| Column 9, line 48, "bt" | should be --by-- |
| Column 11, line 50, "CONFIGURATOON'S" | should be --CONFIGURATION'S-- |
| Column 11, line 56, "Pont" | should be --Point-- |
| Column 15, line 1, "PR2" | should be --RP2-- |
| Column 15, under "IV. A.", "CTM+" | should be --CTM=-- |
| Column 15, under "IV. A.", "SPPED FOR SA WITH EXISTING" | should be --SPEED FOR SA WITH EXISTING BOW-- |
| Column 15, same line as "B.", "REVENGE" | should be --REVENUE-- |

UNITED STATES PATENT AND TRADEMARK OFFICE

CERTIFICATE OF CORRECTION

PATENT NO. : 5,488,918

DATED : February 6, 1996

INVENTOR(S) : Fontain M. Johnson, Jr., and Jerry M. Williams

It is certified that error appears in the above-indentified patent and that said Letters Patent is hereby corrected as shown below:

COLUMN 15, after "C"., in line with "CFC=" should read —CHANGE IN SPEED DOWN—.

Column 17, line 2, "BOWFORMN" should be --BOWFORM--

Column 17, line 6, after last bracket, add --*--

Signed and Sealed this

Twenty-seventh Day of August, 1996

Bruce Lehman

*Attest:*

BRUCE LEHMAN

*Attesting Officer*

*Commissioner of Patents and Trademarks*